US010186777B2

(12) United States Patent
Zhuang

(10) Patent No.: US 10,186,777 B2
(45) Date of Patent: Jan. 22, 2019

(54) ULTRA-WIDEBAND MINIATURIZED CROSSED CIRCULARLY-POLARIZED ANTENNA

(71) Applicant: Kunjie Zhuang, Quanzhou (CN)

(72) Inventor: Kunjie Zhuang, Quanzhou (CN)

( * ) Notice: Subject to any disclaimer, the term of this patent is extended or adjusted under 35 U.S.C. 154(b) by 69 days.

(21) Appl. No.: 15/316,061

(22) PCT Filed: Oct. 14, 2015

(86) PCT No.: PCT/CN2015/091941
§ 371 (c)(1),
(2) Date: Dec. 2, 2016

(87) PCT Pub. No.: WO2016/066016
PCT Pub. Date: May 6, 2016

(65) Prior Publication Data

US 2017/0110800 A1 Apr. 20, 2017

(30) Foreign Application Priority Data

Oct. 30, 2014 (CN) ..... 2014 1 0598931

(51) Int. Cl.
*H01Q 13/10* (2006.01)
*H01Q 9/04* (2006.01)
(Continued)

(52) U.S. Cl.
CPC ..... *H01Q 9/0428* (2013.01); *H01Q 1/36* (2013.01); *H01Q 1/38* (2013.01); *H01Q 9/0457* (2013.01); *H01Q 15/14* (2013.01); *H01Q 21/24* (2013.01)

(58) Field of Classification Search
CPC ..... H01Q 13/10; H01Q 13/085; H01Q 1/38; H01Q 13/18
(Continued)

(56) References Cited

U.S. PATENT DOCUMENTS 6,239,750 B1 * 5/2001 Snygg ..... H01Q 1/246 343/700 MS
6,462,710 B1 10/2002 Carson et al.
(Continued)

FOREIGN PATENT DOCUMENTS

CN 101064381 A 10/2007
CN 102891360 A 1/2013
(Continued)

*Primary Examiner* — Dameon E Levi
*Assistant Examiner* — Collin Dawkins
(74) *Attorney, Agent, or Firm* — Ference & Associates LLC

(57) ABSTRACT

The present disclosure discloses an ultra-wideband miniaturized crossed circularly-polarized antenna, comprising a plurality of radiation sheets, a substrate, a reflecting plate and a phase shifting 90-degree equal power divider, all of which are disposed in order. The front side of the substrate faces the radiation sheets and is provided with an excitation slot. The back side of the substrate faces the reflecting plate and is provided with a first power divider and two first transmission lines, as well as a second power divider and two second transmission lines. Input ends of the first power divider and the second power divider are connected to two input ends of the phase shifting 90-degree equal power divider, respectively. The two first transmission lines and the two second transmission lines orthogonally intersect with the excitation slot and are connected to a metal surface of the front side of the substrate, respectively. The ultra-wideband miniaturized crossed circularly-polarized antenna is provided with multiple layers of radiation sheets different in size and corresponding to different frequency bands to achieve the effect of expanding the frequency band. In addition, conversion between crossed circular polarization and linear polarization is realized by means of the phase shifting 90-degree equal power divider.

8 Claims, 4 Drawing Sheets

(51) Int. Cl.

| | |
|---|---|
| ***H01Q 1/38*** | (2006.01) |
| ***H01Q 1/36*** | (2006.01) |
| ***H01Q 15/14*** | (2006.01) |
| ***H01Q 21/24*** | (2006.01) |

(58) Field of Classification Search
USPC ..... 343/767, 741, 772, 789
See application file for complete search history.

(56) References Cited

U.S. PATENT DOCUMENTS

| | | | | |
|---|---|---|---|---|
| 2007/0001919 | A1* | 1/2007 | Carroll | H01Q 1/246 343/757 |
| 2008/0036665 | A1* | 2/2008 | Schadler | H01Q 1/42 343/700 MS |
| 2011/0025574 | A1 | 2/2011 | Tiezzi et al. | |
| 2013/0044035 | A1* | 2/2013 | Zhuang | H01Q 9/0428 343/770 |

FOREIGN PATENT DOCUMENTS

| | | | |
|---|---|---|---|
| CN | 204130695 | U | 1/2015 |
| CN | 104701603 | A | 6/2015 |

* cited by examiner

ULTRA-WIDEBAND MINIATURIZED CROSSED CIRCULARLY-POLARIZED ANTENNA

FIELD OF THE INVENTION

The present disclosure relates to the field of the antenna technology in the field of mobile communications, and specifically relates to an ultra-wideband miniaturized crossed circularly-polarized antenna.

BACKGROUND OF THE INVENTION

In accordance with the International Radio Regulations, all the existing radio communications are divided into more than 50 different services such as aeronautical communication, marine communication, terrestrial communication, satellite communication, broadcast, television, radio navigation, positioning and telemetering, remote control, space exploration and the like, each having a certain limited frequency band.

In the mobile communication service, all mobile phones have different communication frequency bands, for example, 890-960 MHz for GSM 900, 1710-1850 MHz for GSM1800, and 825-880 MHz for CDMA. In addition, the major operating frequency band for 3G is 1880-2025 MHz, while the frequency band for 4G granted by the Ministry of Industrial and Information Technology of PRC is such high frequency band as 2575-2635 MHz.

At present, there coexist 2G, 3G and 4G communication networks. Regardless of base stations or indoor distribution systems, each communication system is provided with its respective antenna. The existing antennas are narrow in band width; therefore, it is necessary to employ a plurality of antennas different in band width for satisfying the band widths of all 2G, 3G and 4G antennas, thus resulting in high station establishment costs. Multipath fading generally exits in receiving of a linearly-polarized antenna from another linearly-polarized antenna such that radio signals may severely fade at a certain moment. In order to solve this problem, the present base station and terminal antennas all are directed to polarization diversity receiving. That is, dual-channel dual-polarized antennas are employed.

SUMMARY OF THE INVENTION

The present disclosure is intended to overcome the defect of narrow bandwidth of dual-polarized antennas in the prior art. According to one aspect of the present disclosure, an ultra-wideband miniaturized crossed circularly-polarized antenna is provided.

An ultra-wideband miniaturized crossed circularly-polarized antenna provided by the embodiments of the present disclosure includes a plurality of radiation sheets, a substrate, a reflecting plate and a phase shifting 90-degree equal power divider, all of which are disposed in order.

A front side of the substrate faces the radiation sheets and is provided with an excitation slot. A back side of the substrate faces the reflecting plate and is provided with a first power divider and two first transmission lines, as well as a second power divider and two second transmission lines. The first transmission lines and the second transmission lines are transmission lines of two crossed linearly-polarized antennas polarized orthogonally, respectively. The two first transmission lines are connected to two output ends of the first power divider, respectively, and the two second transmission lines are connected to two output ends of the second power divider, respectively.

Input ends of the first power divider and the second power divider are connected to two input ends of the phase shifting 90-degree equal power divider, respectively.

The two first transmission lines and the two second transmission lines orthogonally intersect with the excitation slot and are connected to a metal surface of the front side of the substrate, respectively, and four orthogonal points at which the transmission lines orthogonally intersect with the excitation slot are distributed symmetrically.

The plurality of radiation sheets are circular radiation sheets disposed in parallel to one another, and as distances of the radiation sheets away from the substrate become bigger, diameters of the radiation sheets become smaller.

In the above technical solutions, the excitation slot is in a symmetrical gradual changing form, including a cross-shaped gradual changing form, a rhombic crossed gradual changing form, and an H-shaped gradual changing shape.

The excitation slot is narrowest at short circuit feed points and becomes wider as getting closer to a central position of the excitation slot, the short circuit feed points being the orthogonal points at which the transmission lines orthogonally intersect with the excitation slot.

In the above technical solutions, a circular metal surface forming capacitive coupling with the excitation slot is further provided at the central position of the crossed slot and surrounded by the crossed slot.

In the above technical solutions, the back side of the substrate is provided with a crossed slot in the same form as the excitation slot at a mapping position of the excitation slot in the front side of the substrate, and the crossed slot communicates with each transmission line branch.

A circular metal surface forming capacitive coupling with the excitation slot is provided at a central position of the crossed slot and surrounded by the crossed slot.

In the above technical solutions, the substrate is provided with a plurality of via holes that are distributed along edges of the transmission lines and/or edges of the excitation slots, and the metal surface of the front side of the substrate is connected with a metal surface of the back side of the substrate by means of the via holes.

The ultra-wideband miniaturized crossed circularly-polarized antenna provided by the embodiments of the present disclosure is provided with multiple layers of radiation sheets different in size and corresponding to different frequency bands to achieve the effect of expanding the frequency band. Two transmission signals polarized with a phase difference of 90 degrees are transmitted by the first transmission line and the second transmission line, respectively. Each signal is divided into two branch signals by a two-road equal-power divider. The four transmission line branches simultaneously excite the crossed star-like excitation slot to generate four feeds, and the resulting electromagnetic waves excite the multiple layers of radiation sheets to produce a plurality of standing wave type electromagnetic fields different in frequency in the multiple layers of thin-layer space. Besides, these radiation sheets are secondarily excited by the reflecting plate, causing the electromagnetic waves to produce multiple resonances in different frequency bands corresponding to the multiple layers of radiation sheets different in size, thus achieving the effect of expanding the frequency band. The phase shifting 90-degree equal power divider is added such that the output crossed linearly-polarized waves are formed into crossed circularly-polarized waves in space that are dissipated through a spatial distance and polarization to allow a corresponding antenna port isolation degree for the antenna. The crossed circularly-polarized antenna substituting for the crossed linearly-polarized antenna not only is better than the linearly-polarized antenna in receiving capability, but also has the advantages of interference resistance, fading resistance and better stability. Moreover, the antenna is changed from two terminals into one terminal, thereby increasing the channel utilization rate, reducing the size and saving the cost.

Other features and advantages of the present disclosure will be described in the following description, and will become apparent from the description or be known by implementing the present disclosure. The objective and other advantages of the present disclosure may be realized and achieved by means of the structure particularly described in the written description, claims and accompanying drawings.

The technical solutions of the present disclosure will be further described in detail below by means of the accompanying drawings and the embodiments.

BRIEF DESCRIPTION OF THE DRAWINGS

The accompanying drawings are applied for further understanding of the present disclosure and form part of the description to explain the present disclosure together with the embodiments of the present disclosure, rather than limit the present disclosure, in which.

DETAILED DESCRIPTION OF THE EMBODIMENTS

The specific implementations of the present disclosure will be described in detail below in conjunction with the accompanying drawings. But, it should be understood that the protection scope of the present disclosure is not limited by the specific implementations.

Figure 1:
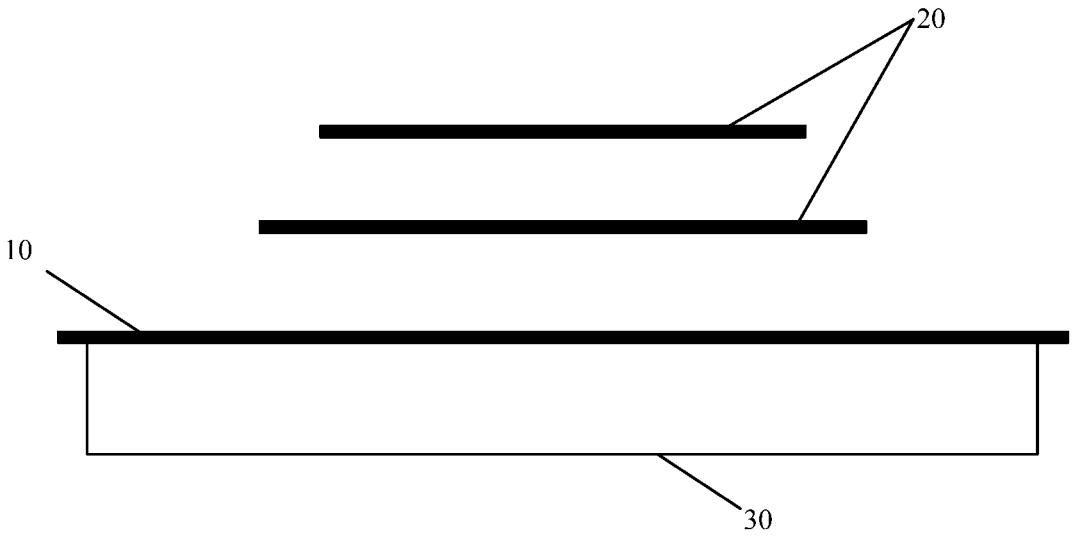
FIG. 1 is a structure diagram of an ultra-wideband miniaturized crossed circularly-polarized antenna in an embodiment of the present disclosure.
Figure 2:
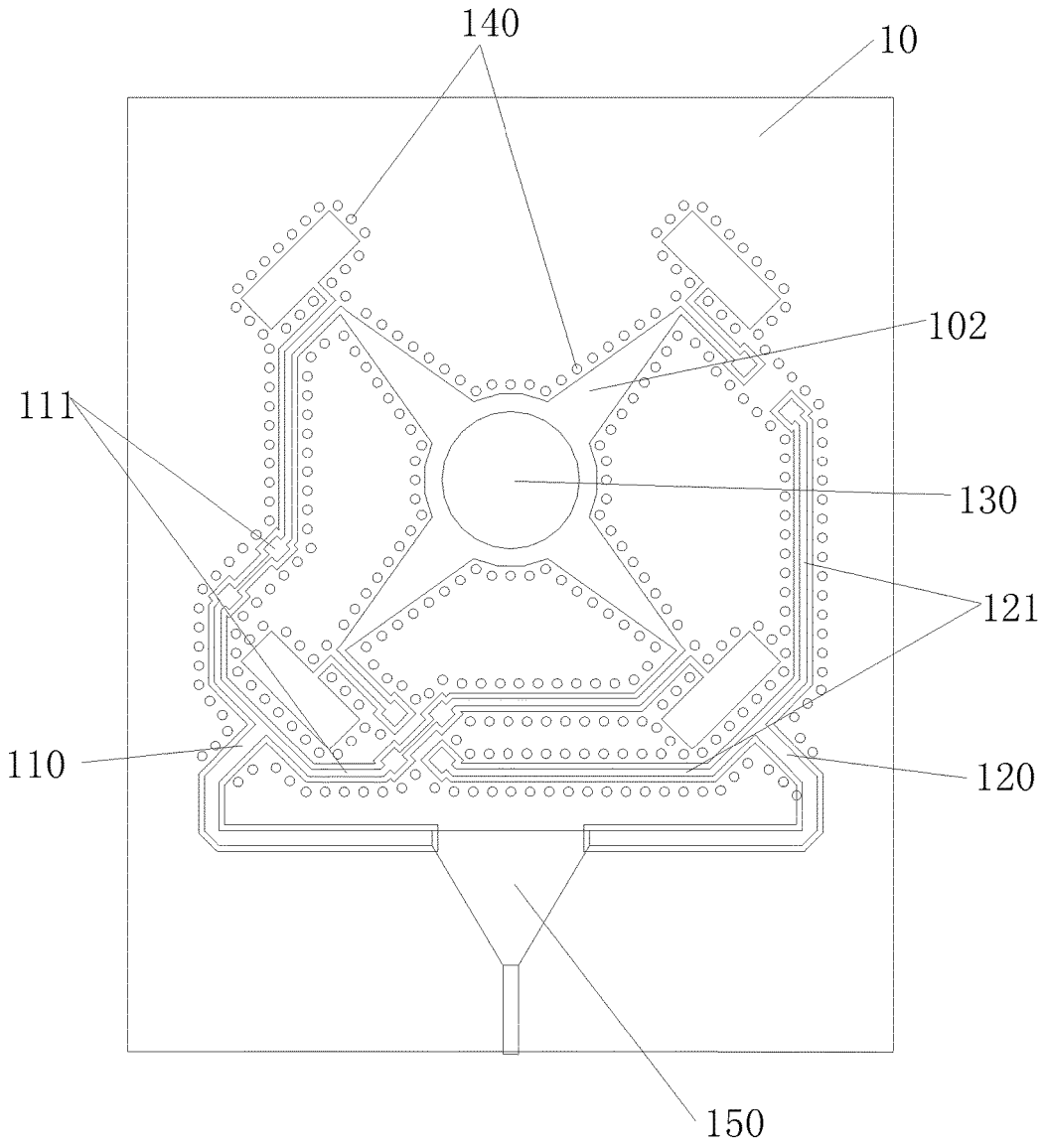
FIG. 2 is a structure diagram of a back side of a substrate in an embodiment of the present disclosure.
Figure 3:
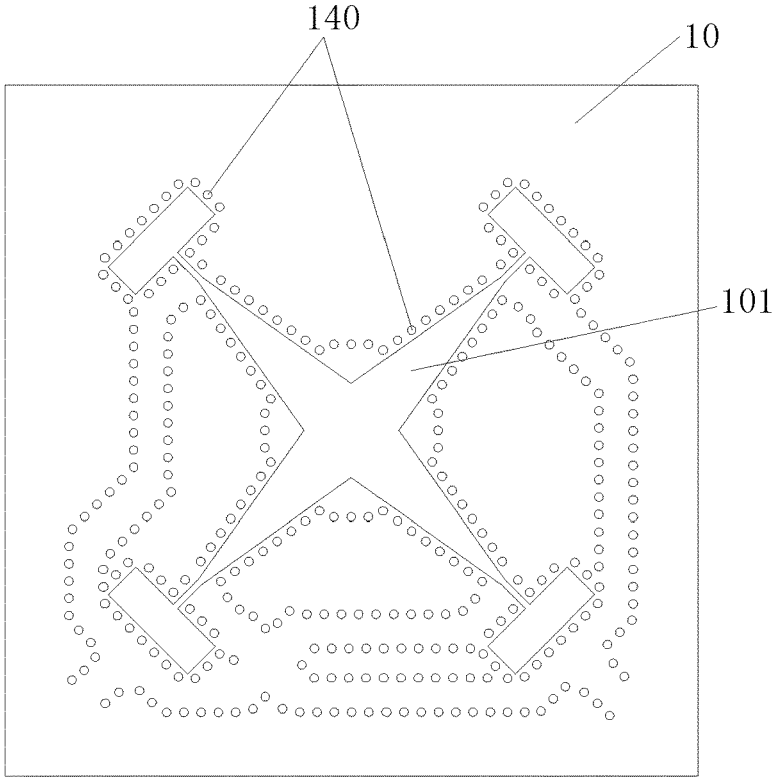
FIG. 3 is a structure diagram of a front side of a substrate in an embodiment of the present disclosure.
Figure 4:
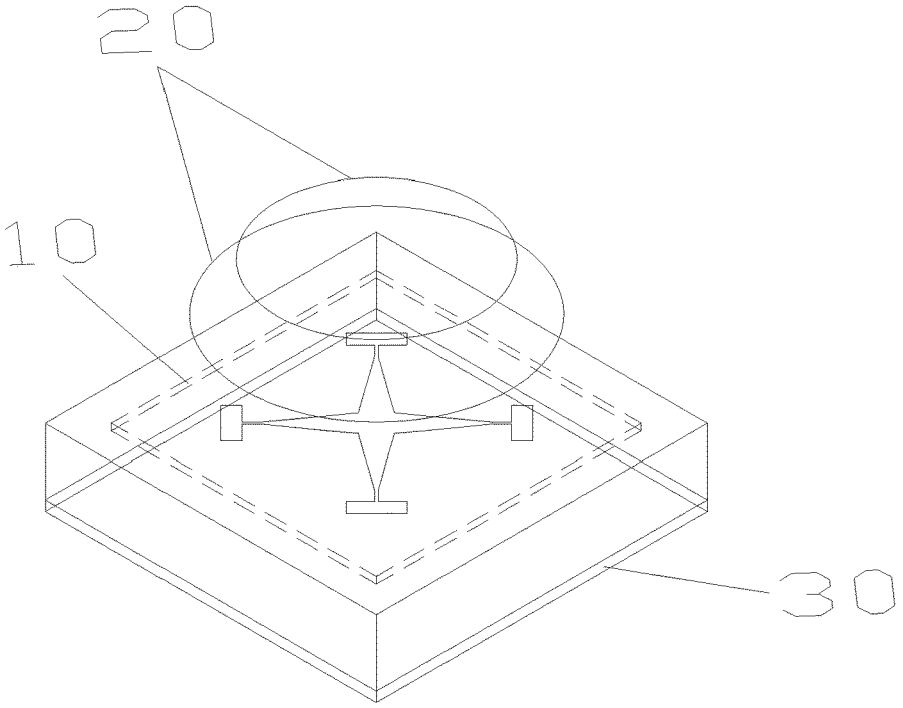
FIG. 4 is a three-dimensional structure diagram of an ultra-wideband miniaturized crossed circularly-polarized antenna in an embodiment of the present disclosure.

According to an embodiment of the present disclosure, an ultra-wideband miniaturized crossed circularly-polarized antenna is provided. FIG. 1 is the structure diagram of the ultra-wideband miniaturized crossed circularly-polarized antenna provided by the embodiment of the present disclosure, while FIG. 2 and FIG. 3 are the back side structure diagram and the front side structure diagram of the substrate, respectively, and FIG. 4 is the three-dimensional structure diagram of the crossed circularly-polarized antenna. Specifically, the ultra-wideband miniaturized crossed circularly-polarized antenna is provided with a plurality of radiation sheets 20, a substrate 10, and a reflecting plate 30 in order, wherein the radiation sheets 20 may be fixed to the substrate 10 by means of a radiation sheet bracket. It will be understood by a person skilled in the art that the radiation sheets 20 may also be fixed in other ways, and the use of the radiation sheet bracket is just one specific implementation.

Wherein, the front side of the substrate 10 faces the radiation sheets 20 and is provided with an excitation slot 101. The back side of the substrate 10 faces the reflecting plate 30, and is provided with a first power divider 110 and two first transmission lines 111, as well as a second power divider 120 and two second transmission lines 121. The first transmission lines 111 and the second transmission lines 121 are transmission lines of two crossed linearly-polarized antennas polarized orthogonally, respectively. The two first transmission lines 111 are connected to the two output ends of the first power divider 110, respectively, and the two second transmission lines 121 are connected to the two output ends of the second power divider 120, respectively. Specifically, the first power divider 110 and the second power divider 120 both are two-road equal-power dividers.

The two first transmission lines 111 and the two second transmission lines 121 orthogonally intersect with the excitation slot 101 and are connected to a metal surface of the front side of the substrate 10, respectively, and four orthogonal points at which the transmission lines orthogonally intersect with the excitation slot 101 are distributed symmetrically. The plurality of radiation sheets 20 are circular radiation sheets disposed in parallel to one another, and as distances of the radiation sheets away from the substrate become bigger, diameters of the radiation sheets become smaller, as shown in detail in FIG. 1.

The ultra-wideband miniaturized crossed circularly-polarized antenna further includes a phase shifting 90-degree equal power divider 150. As shown in FIG. 1, the phase shifting 90-degree equal power divider 150 may be disposed on the back side of the substrate. Wherein, the input ends of the first power divider 110 and the second power divider 120 are connected to the two input ends of the phase shifting 90-degree equal power divider 150, respectively. The output end of the phase shifting 90-degree equal power divider 150, serving as the transmitting end or the receiving end of the crossed circularly-polarized antenna, is capable of outwardly outputting crossed circularly-polarized antenna signals.

Figure 5:
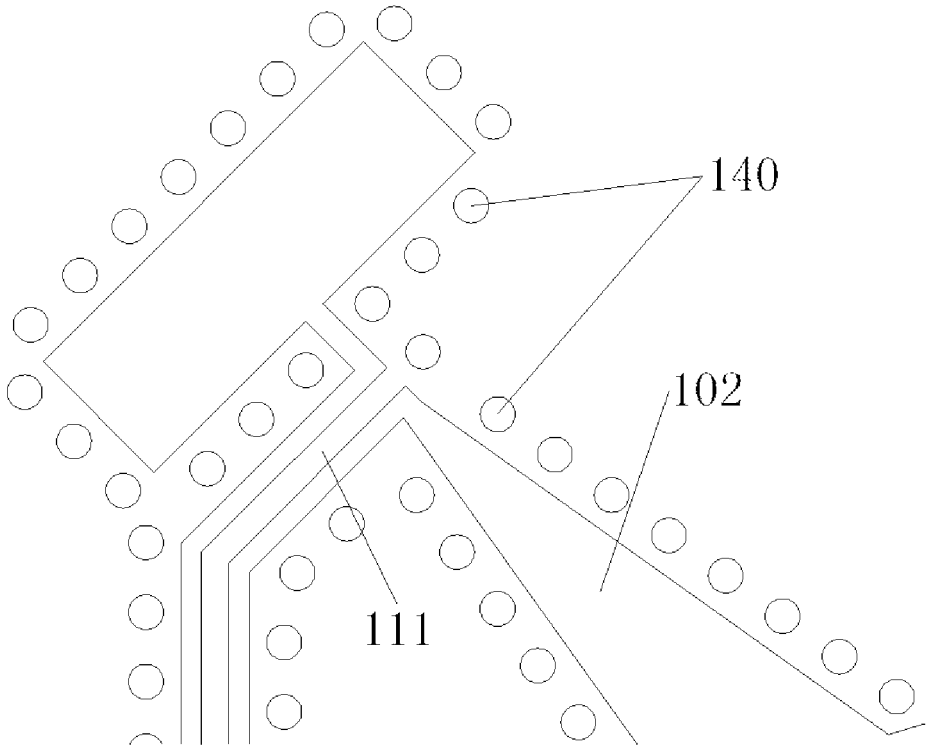
FIG. 5 is a detailed structure diagram of short circuit feed points of a substrate in an embodiment of the present disclosure.

Preferably, the excitation slot 101 is in a symmetrical gradual changing form, including but not limited to a cross-shaped gradual changing form, a rhombic crossed gradual changing form, and an H-shaped gradual changing shape. Specifically, as shown in FIG. 2 and FIG. 3, the excitation slot is narrowest at short circuit feed points and becomes wider as getting closer to a central position of the excitation slot, and the short circuit feed points are the orthogonal points at which the transmission lines orthogonally intersect with the excitation slot. The detailed structure diagram of the short circuit feed points are shown in FIG. 5.

In FIG. 2, the back side of the substrate is provided with a crossed slot 102 in the same form as the excitation slot 101 at a mapping position of the excitation slot 101 in the front side of the substrate, and the crossed slot 102 communicates with each transmission line branch. In the crossed circularly-polarized antenna provided by the embodiment of the present disclosure, a circular metal surface 130 forming capacitive coupling with the excitation slot is further provided at the central position of the crossed slot and surrounded by the crossed slot. The circular metal surface 130 does not communicate with a metal surface of the back side of the substrate 10. The circular metal surface 130 can reduce the length of the excitation slot 102 and be conducive to minimization of the antenna.

Preferably, the substrate 10 is provided with a plurality of via holes 140 that are distributed along edges of the transmission lines and/or edges of the excitation slots in such a distribution form as shown in FIG. 2 and FIG. 3. The metal surface of the front side of the substrate is connected with the metal surface of the back side of the substrate by means of the via holes.

Specifically, provided is more than one via hole. In the front side of the substrate, as shown in FIG. 3, other region of the front side of the substrate apart from the excitation slot 101 is widely cladded with copper, and the copper-cladded region of the front side of the substrate is the metal surface of the front side of the substrate, which also serves as a metal grounding surface. Similarly, apart from the crossed slot 102, the power dividers (including the first power divider 110 and the second power divider 120), and the transmission lines (including the first transmission lines 111 and the second transmission lines 121) of the back side of the substrate, other region of the back side of the substrate is widely cladded with copper, and the copper-cladded region of the back side of the substrate is the metal surface of the back side of the substrate.

The metal surface of the front side of the substrate is connected with the metal surface of the back side of the substrate by means of the via holes such that the two metal surfaces become a common ground surface, thus reducing the interference of plane waves produced by the transmission lines with the electromagnetic fields and better stabilizing the performance of the antenna. The two first transmission lines 111 and the two second transmission lines 121 are connected with the metal surface of the front side of the substrate 10 by means of the via holes 140. That is, the terminals (the output ends) of the transmission lines are grounded, i.e., short-circuited, thereby reducing coupling between the four feed points feeding from the transmission lines to the excitation slot 102.

The ultra-wideband miniaturized crossed circularly-polarized antenna provided by the embodiment of the present disclosure is added with the phase shifting 90-degree equal power divider such that the output crossed linearly-polarized waves are formed into the crossed circularly-polarized waves in space. The near-zone field crossed circularly-polarized waves emitted by the crossed circularly-polarized antenna are dissipated through a spatial distance and polarization, thereby allowing a corresponding antenna port isolation degree for the antenna.

As compared to the linearly-polarized antenna, the circularly-polarized antenna has the advantages in the following aspects.

(1) The circularly-polarized antenna is capable of receiving any linearly-polarized incoming wave, and the waves radiated by the circularly-polarized antenna can be received by any linearly-polarized antenna.

(2) Because of the polarization orthogonality of the circularly-polarized antenna, if the antenna radiates left-handed circularly-polarized waves, only the left-handed circularly-polarized waves rather than right-handed circularly-polarized waves are received.

(3) When the circularly-polarized waves are incident into a symmetrical object (e.g., a plane, a spherical surface and the like), the turning direction thereof is reversed; therefore the circularly-polarized antenna is capable of suppressing rain and fog interference and resisting multipath reflection when applied to mobile communications.

Hence, the circularly-polarized antenna is better than the linearly-polarized antenna in anti-fading, anti-interference and anti-multipath effect.

When the crossed circularly-polarized antenna receives a signal from the linearly-polarized antenna, the same effect as a dual-polarized dual-channel antenna may be achieved because crossed circular polarization can be split into dual orthogonal linear polarizations, i.e., having directions perpendicular to each other and a phase difference of 90 degrees. Moreover, the transmitting power of the dual-polarized antenna will be transmitted to the antenna in two paths, leading to 3 dB loss in the downlink. The single-channel crossed circularly-polarized antenna also has 3 dB power loss in receiving from the linearly-polarized antenna with one channel saved. As a result, the crossed circularly-polarized antenna is capable of completely taking the place of the dual-polarized antenna. The existing covering antennas generally are the dual-polarized antennas. When receiving by one dual-polarized antenna from another dual-polarized antenna, although polarization diversity is employed as well to reduce multipath fading, the dual-polarized antennas are still not comparable to the circularly-polarized antenna in anti-interference and anti-fading.

In addition, the crossed circularly-polarized antenna is employed to substitute for a crossed linearly-polarized antenna. A base station and a terminal both employ the crossed linearly-polarized antennas. When two orthogonal linearly-polarized antennas receive one single crossed circularly-polarized wave, a polarization matching factor thereof is 1, i.e., the most ideal polarization matching state. Besides, the received signal power is unrelated to the positions of the transmitting and receiving antennas and does not depend on the directions of the antennas. That is, when the circularly-polarized antenna still keeps good transmitting and receiving capability toward the linearly-polarized antennas even after being interfered with barriers, the circularly-polarized waves received by the two crossed linearly-polarized antennas at the receiving end are always identical in energy. Similarly, so it is when the crossed circularly-polarized antenna receives the crossed linearly-polarized waves. The crossed circularly-polarized antenna substituting for the crossed linearly-polarized antenna not only is better than the linearly-polarized antenna in receiving capability, but also has the advantages of interference resistance, fading resistance and better stability. Moreover, the antenna is changed from two terminals into one terminal, thereby increasing the channel utilization rate, reducing the size and saving the cost.

In the ultra-wideband miniaturized crossed circularly-polarized antenna provided by the embodiment of the present disclosure, two transmission signals polarized with the phase difference of 90 degrees are transmitted by the first transmission lines and the second transmission lines, respectively. Each signal is divided into two branch signals by the two-road equal-power divider. The four transmission line branches simultaneously excite the crossed star-like excitation slot to generate four feeds, and the resulting electromagnetic waves excite the multiple layers of radiation sheets to produce a plurality of standing wave type electromagnetic fields different in frequency in the multiple layers of thin-layer space. Besides, these radiation sheets are secondarily excited by the reflecting plate, causing the electromagnetic waves to produce multiple resonances in different frequency bands corresponding to the multiple layers of radiation sheets different in size, thus achieving the effect of expanding the frequency band. The phase shifting 90-degree equal power divider is added such that the output crossed linearly-polarized waves are formed into crossed circularly-polarized waves in space that are dissipated through a spatial distance and polarization to allow a corresponding antenna port isolation degree for the antenna. The crossed circularly-polarized antenna substituting for the crossed linearly-polarized antenna not only is better than the linearly-polarized antenna in receiving capability, but also has the advantages of interference resistance, fading resistance and better stability. Moreover, the antenna is changed from two terminals into one terminal, thereby increasing the channel utilization rate, reducing the size and saving the cost.

The present disclosure may have a plurality of specific implementations in different forms. The technical solutions of the present disclosure are illustrated above for example with the accompanying drawings FIG. 1 to FIG. 5, but it does not mean that the specific examples applied in the present disclosure are only limited to specific flows or embodiment structures. It should be understood by a person of ordinary skill in the art that the specific implementations provided above are some examples in a plurality of preferred usages, and any implementations embodying the claims of the present disclosure should fall into the scope claimed by the technical solutions of the present disclosure.

Finally, it should be noted that the foregoing descriptions are merely preferred embodiments of the present disclosure and not intended to limit the present disclosure. While the present disclosure is described in detail with reference to the above embodiments, for a person skilled in the art, modifications can still be made to the technical solutions recorded in the above embodiments or equivalent substitutions can be made to part of the technical features therein. Any modification, equivalent substitution, improvement and the like made within the spirit and principle of the present disclosure should all fall into the protection scope of the present disclosure.

The invention claimed is:

1. An ultra-wideband miniaturized crossed circularly-polarized antenna, comprising a plurality of radiation sheets, a substrate, a reflecting plate and a phase shifting 90-degree equal power divider;

wherein a front side of the substrate faces the plurality of radiation sheets and wherein the front side of the substrate is provided with an excitation slot;

a back side of the substrate faces the reflecting plate and wherein the back side of the substrate is provided with a first power divider, two first transmission lines, and a second power divider and two second transmission lines;

the two first transmission lines and the two second transmission lines are transmission lines of two crossed linearly-polarized antennas polarized orthogonally, respectively;

the two first transmission lines are connected to two output ends of the first power divider, respectively, and the two second transmission lines are connected to two output ends of the second power divider, respectively;

input ends of the first power divider and the second power divider are connected to two input ends of the phase shifting 90-degree equal power divider, respectively;

the two first transmission lines and the two second transmission lines orthogonally intersect with the excitation slot and are connected to a metal surface of the front side of the substrate, respectively, and four orthogonal points at which the two first transmission lines and the two second transmission lines orthogonally intersect with the excitation slot are distributed symmetrically;

the plurality of radiation sheets are circular radiation sheets disposed in parallel to one another, and a diameter of each of the plurality of radiation sheets decreases when a distance between each of the plurality of radiation sheets and the substrate increases.

2. The crossed circularly-polarized antenna according to claim 1, wherein the excitation slot is in a symmetrical gradual changing form, comprising a cross-shaped gradual changing form, a rhombic crossed gradual changing form, and an H-shaped gradual changing shape;

the excitation slot is narrowest at short circuit feed points and becomes wider as getting closer to a central position of the excitation slot, the short circuit feed points being the orthogonal points at which the two first transmission lines and the two second transmission lines orthogonally intersect with the excitation slot.

3. The crossed circularly-polarized antenna according to claim 1, wherein a circular metal surface forming capacitive coupling with the excitation slot is further provided at the central position of a crossed slot and surrounded by the crossed slot.

4. The crossed circularly-polarized antenna according to claim 1, wherein the back side of the substrate is provided with a crossed slot in the same form as the excitation slot at a mapping position of the excitation slot in the front side of the substrate, and the crossed slot communicates with each transmission line branch;

a circular metal surface forming capacitive coupling with the excitation slot is provided at the central position of the crossed slot and surrounded by the crossed slot.

5. The crossed circularly-polarized antenna according to claim 1, wherein the substrate is provided with a plurality of via holes that are distributed along edges of the transmission lines and/or edges of the excitation slots, and the metal surface of the front side of the substrate is connected with a metal surface of the back side of the substrate by means of the via holes.

6. The crossed circularly-polarized antenna according to claim 2, wherein a substrate is provided with a plurality of via holes that are distributed along edges of the transmission lines and/or edges of the excitation slot, and the metal surface of a front side of the substrate is connected with a metal surface of the back side of the substrate by means of a plurality of via holes.

7. The crossed circularly-polarized antenna according to claim 3, wherein a substrate is provided with a plurality of via holes that are distributed along edges of a transmission line and/or edge of the excitation slot, and the metal surface of a front side of the substrate is connected with a metal surface of the back side of the substrate by means of the via holes.

8. The crossed circularly-polarized antenna according to claim 4, wherein the substrate is provided with a plurality of via holes that are distributed along edges of a transmission line and/or edge of the excitation slots, and a metal surface of the front side of the substrate is connected with a metal surface of the back side of the substrate by means of the via holes.

* * * * *